US008269690B1

(12) United States Patent
Caruso

(10) Patent No.: US 8,269,690 B1
(45) Date of Patent: Sep. 18, 2012

(54) CELLULAR TELEPHONE ANTENNA SUPPORT STRUCTURE

(76) Inventor: Ken Caruso, Bloomington, CA (US)

( * ) Notice: Subject to any disclaimer, the term of this patent is extended or adjusted under 35 U.S.C. 154(b) by 335 days.

(21) Appl. No.: 11/110,150

(22) Filed: Apr. 20, 2005

(51) Int. Cl.
*H01Q 1/12* (2006.01)

(52) U.S. Cl. ..... 343/890; 52/723.1

(58) Field of Classification Search ..... 343/890, 343/871, 874, 878, 893, 891, 797, 853; 52/723.1, 52/726.4, 736.1
See application file for complete search history.

(56) References Cited

U.S. PATENT DOCUMENTS

| | | | | |
|---|---|---|---|---|
| 4,899,500 | A | 2/1990 | Miller | 52/146 |
| 5,101,215 | A | 3/1992 | Creaser | 343/883 |
| 5,531,419 | A | 7/1996 | Gustafsson | 248/519 |
| 5,581,958 | A * | 12/1996 | Cote | 52/40 |
| 5,944,413 | A | 8/1999 | Crookham | 362/431 |
| 6,453,636 | B1 * | 9/2002 | Ritz | 52/835 |
| 6,702,522 | B2 | 3/2004 | Silber | 405/229 |
| 6,709,172 | B2 * | 3/2004 | Brown | 396/427 |
| 6,915,618 | B2 * | 7/2005 | Payne | 52/849 |
| 7,098,864 | B2 * | 8/2006 | Ryan | 343/890 |
| 7,253,786 | B1 * | 8/2007 | Logozzo | 343/890 |
| 2002/0140621 | A1 * | 10/2002 | Harrison | 343/890 |
| 2004/0258404 | A1 * | 12/2004 | Brown | 396/427 |

* cited by examiner

*Primary Examiner* — Jacob Y Choi
*Assistant Examiner* — Jimmy T Vu
(74) *Attorney, Agent, or Firm* — Dennis W. Beech

(57) ABSTRACT

The present invention may be used to locate and position a cellular telephone antenna. A base may have four side plates attached to a bottom plate and between adjacent edges to form a generally rectangular open top container wherein the container may be sized to support in a free standing manner a pole that may have attached at a top end a cellular telephone antenna when the container may be filled with a concrete material. There may be multiple bolts disposed in the concrete material with a threaded end extending above the upper surface of the concrete material. The pole may have a pole plate attached at a bottom end and a cellular telephone antenna element attached at a top end. The pole plate may have apertures positioned for mating with the bolts for attachment to the base.

11 Claims, 2 Drawing Sheets

CELLULAR TELEPHONE ANTENNA SUPPORT STRUCTURE

BACKGROUND OF THE INVENTION

This invention relates to mobile structures that may include an antenna pole for positioning a cellular telephone antenna that may be used for transmitting and receiving electromagnetic signals. The new structure may have a base with an attached pole and cellular telephone antenna element that is sized and ballasted to support the structure in a free standing manner in foreseeable wind and other environmental force conditions.

Various temporarily erected and movable structures may be used to position transmitting and receiving antennas at desired locations in an elevated position until a more permanent location and structure may be located. This may be particularly true in a rapidly growing industry such as the cellular telephone business that may be constantly locating new antenna sites. A temporary site may require an antenna height of 60 feet in a location that may be a parking lot, an existing ground site or other existing location that has space to temporarily place an antenna. Currently used structures for antennas generally require guy wires or cables, horizontal extending support legs or arms, or other like add on elements to support a temporary 60 foot elevated antenna. While temporary lighting structures may also be known, these apparatus may not be structured for a 60 foot elevated element without extra support structural elements.

SUMMARY OF THE INVENTION

The present invention is directed to structures for positioning a cellular telephone antenna. A base may have four side plates attached at adjacent edges and to a bottom plate to form a generally rectangular open top container wherein the container when having a concrete material disposed therein may be sized to support in a free standing manner a pole that may have attached at a top end a cellular telephone antenna. There may be multiple bolts disposed in the concrete material with a threaded end extending above the upper surface of the concrete material. The pole may have a pole plate attached at a bottom end and a cellular telephone antenna element attached at a top end. The pole plate may have apertures positioned for mating with the bolts for attachment to the base.

These and other features, aspects and advantages of the present invention will become better understood with reference to the following drawings, description and claims.

DETAILED DESCRIPTION

The following detailed description represents the best currently contemplated modes for carrying out the invention.

The description is not to be taken in a limiting sense, but is made merely for the purpose of illustrating the general principles of the invention.

Figure 1:
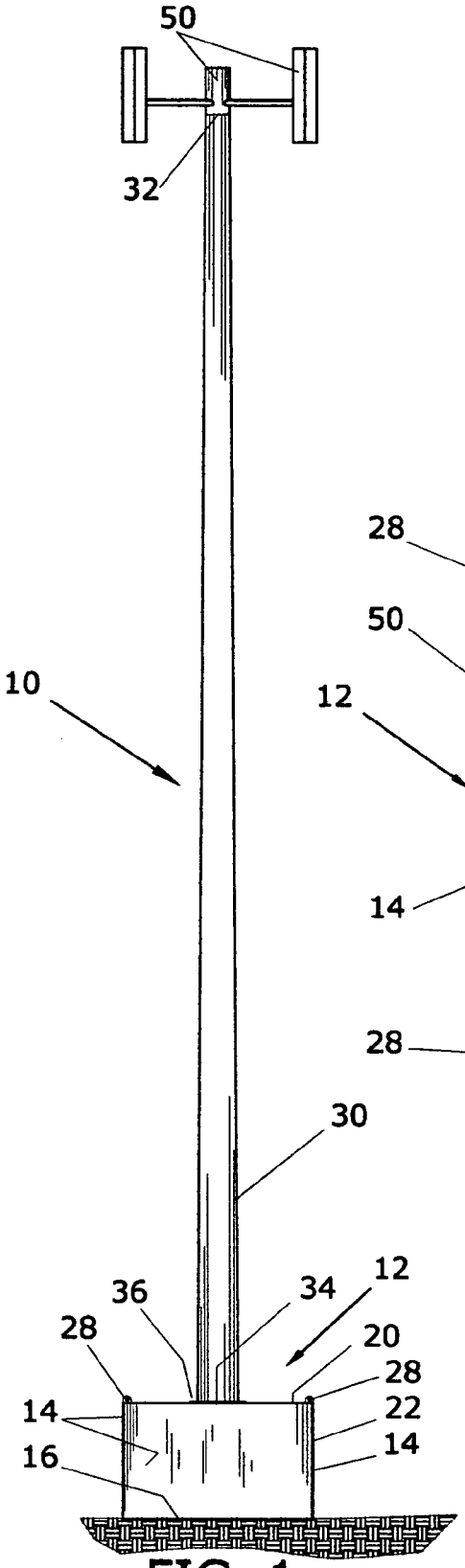
FIG. 1 illustrates a side elevation view of a support structure according to an embodiment of the invention.

Referring to FIG. 1, a cellular telephone antenna support structure 10 may have a base 12 with a pole 30 attached in an upstanding orientation and a cellular telephone antenna element 50 attached at a top end 32 of the pole 30. The base 12 may have four side plates 14 and a bottom plate 16 that may be made of steel or other suitable composite material that may form a container 22 with an open top 20. The pole 30 may have a pole plate 36 at a bottom end 34 for attachment to the base 12. There may be lifting elements 28 attached adjacent to each of the four upper corners of the container 22. The pole 30 length and base 12 height may be sized to support a cellular telephone antenna element 50 at a height of 60 feet above the ground or other surface. The container 22 with the concrete material 24 and the pole 30 may weigh approximately 56,780 pound.

Figure 2:
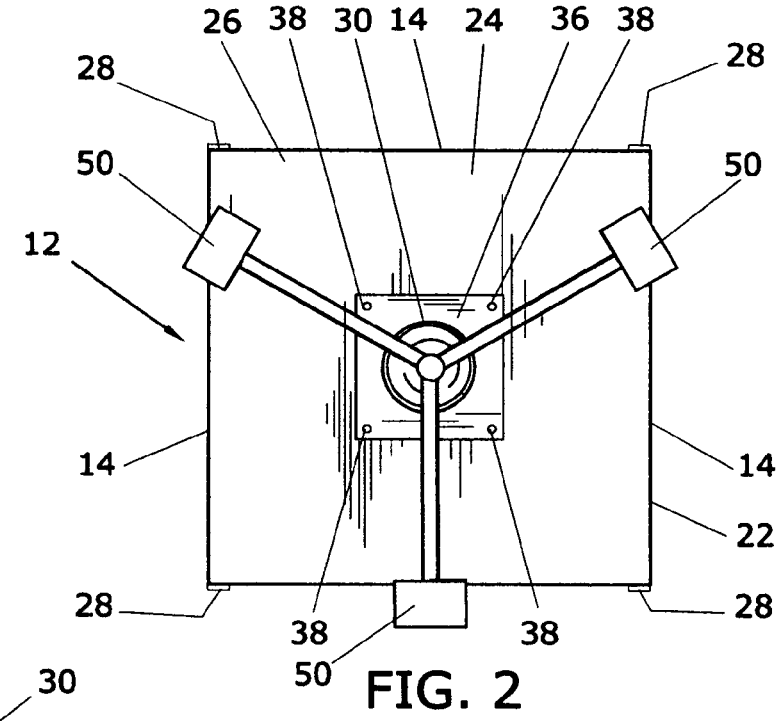
FIG. 2 illustrates a top view of a support structure according to an embodiment of the invention.
Figure 3:
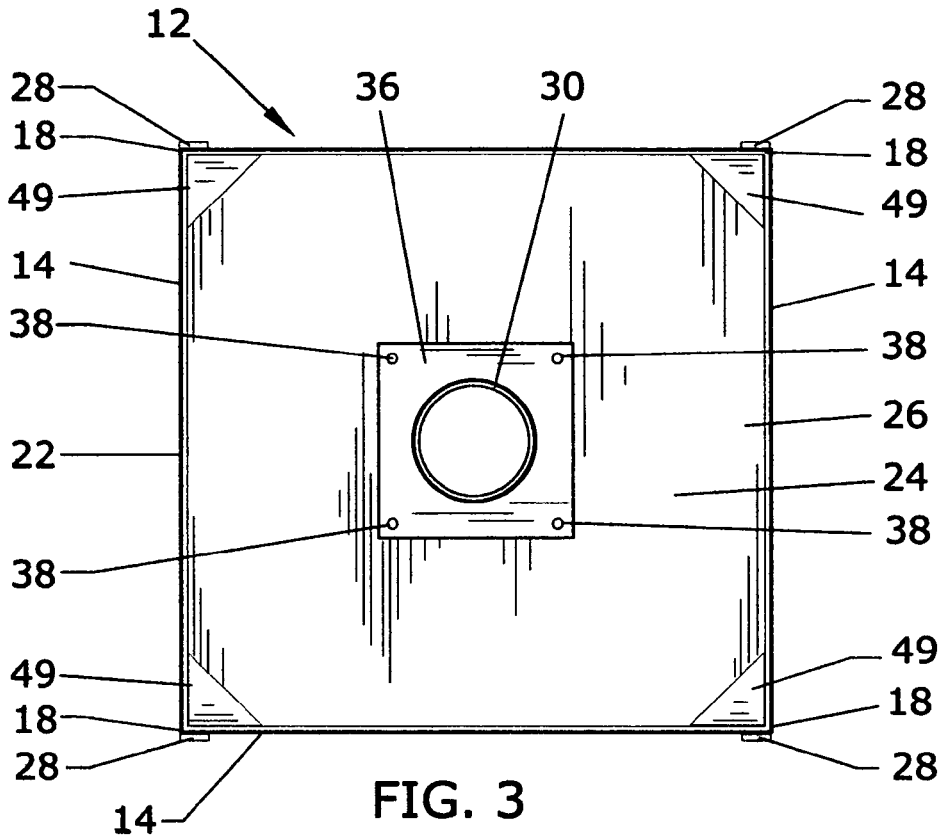
FIG. 3 illustrates a top view of a support structure without an antenna element according to an embodiment of the invention.
Figure 4:
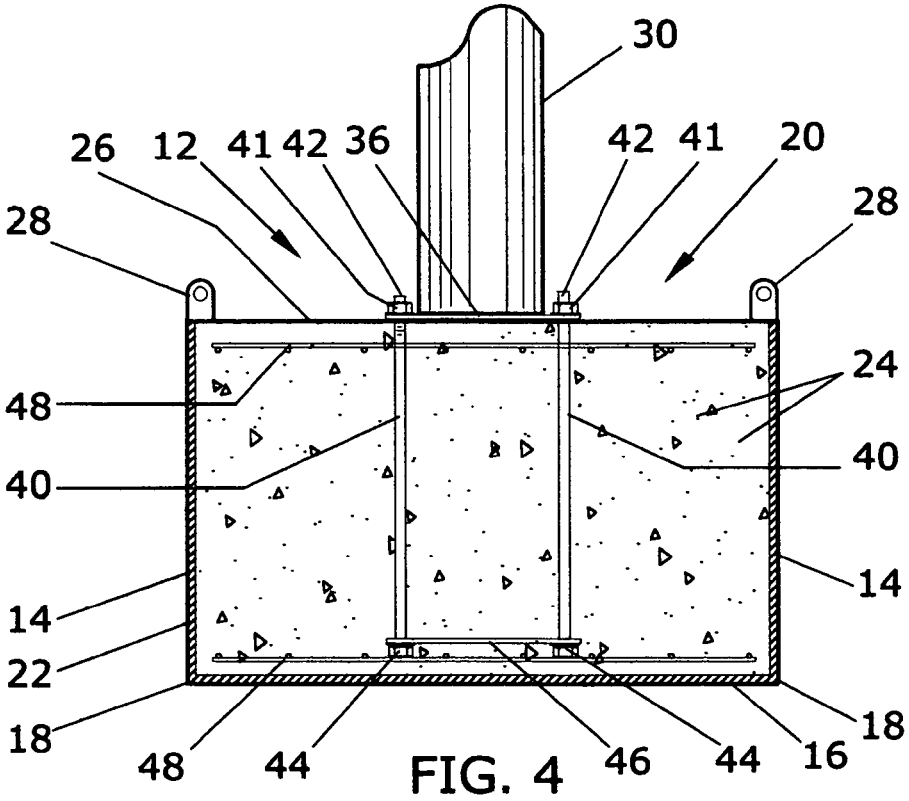
FIG. 4 illustrates a side partial cross section view of a support structure according to an embodiment of the invention.

Referring to FIGS. 2 through 4, the base 12 bottom plate 16 may be approximately 8 square feet and approximately ¾ inches thick and each of the four side plates 14 may be approximately 8 feet wide by approximately 5 feet high by approximately ¾ inches thick and the container 22 may be filled with a concrete material 24 or other ballast material that may harden to retain bolts 40, of which four are illustrated, therein. The bolts 40 may protrude above the upper surface 26 at a threaded end 42 for attachment of nuts 41. The pole plate 36 may have apertures 38 positioned to mount on threaded ends 42 to be secured by nuts 41. There may also be an anchor plate 46 positioned on bolts 40 adjacent the bolt heads 44 for additional structural strength in attachment of the pole 30 to the base 12. The pole plate 36 and the anchor plate 46 may each be approximately 32 square inches and 1 inch thick.

Referring to FIG. 3, there may be corner support plates 49 attached to adjacent side plates 14 in the upper corner of the container 22. Referring to FIG. 4, there may be one or more reinforcing rod matrices embedded in the concrete material 24 for structural support. An upper and lower reinforcing rod matrix 48 are illustrated in a generally horizontal orientation.

In use the support structure 10 may be positioned at a transmit/receive site by a crane that may use the lifting elements 28. This may be accomplished with the support structure 10 assembled. The support structure 10 may be transported by removing nuts 41 and transporting the base 12 and pole 30 as separated elements.

While the invention has been particularly shown and described with respect to the illustrated embodiments thereof, it will be understood by those skilled in the art that the foregoing and other changes in form and details may be made therein without departing from the spirit and scope of the invention.

I claim:

1. A structure for positioning a cellular telephone antenna comprising:

a base having four side plates attached at adjacent edges and to a bottom plate to form a generally rectangular open top container wherein said bottom plate is approximately 8 square feet and approximately ¾ inches thick and each of said side plates are approximately 8 feet wide by approximately 5 feet high by approximately ¾ inches thick, and wherein said container having a concrete material disposed therein is sized to support in a free standing manner and in an upstanding position in foreseeable wind and other environmental forces a pole having attached at a top end the cellular telephone antenna;

a plurality of bolts disposed in said concrete material with a threaded end extending above an upper surface of said concrete material; and said pole having a pole plate attached at a bottom end and a cellular telephone antenna element attached at a top end wherein said pole plate having apertures positioned for mating with said plurality of bolts for attachment to said base.

2. The structure as in claim 1 wherein a lifting element having an aperture therein is attached to each upper corner of said container.

3. The structure as in claim 1 wherein said four side plates and said bottom plate are made of steel and said attachment of said four side plates and said bottom plate is by welding.

4. The structure as in claim 1 wherein the length from said top end to said bottom plate is approximately 60 feet.

5. The structure as in claim 1 wherein said container with said concrete material and said pole weigh approximately 56,780 pounds.

6. The structure as in claim 1 wherein there is an anchor plate disposed on said plurality of bolts positioned adjacent a bolt head and disposed in said concrete material.

7. The structure as in claim 6 wherein said pole plate and said anchor plate are approximately 32 square inches and 1 inch thick.

8. The structure as in claim 7 wherein said pole plate and said anchor plate are made of steel.

9. The structure as in claim 1 wherein said pole is a hollow steel pole.

10. The structure as in claim 1 wherein there is a reinforcing rod matrix disposed in said concrete material.

11. The structure as in claim 1 wherein a corner support plate is attached to adjacent side plates at an upper corner.

* * * * *